US009637265B2

(12) United States Patent
Kim

(10) Patent No.: US 9,637,265 B2
(45) Date of Patent: May 2, 2017

(54) ORIGAMI SHEET FOR MAKING REGULAR HEXAHEDRON BOX, ORIGAMI MONEY BOX, AND ORIGAMI PACKAGING BOX

(71) Applicant: Hae Jin Kim, Yangju-si (KR)

(72) Inventor: Hae Jin Kim, Yangju-si (KR)

( * ) Notice: Subject to any disclaimer, the term of this patent is extended or adjusted under 35 U.S.C. 154(b) by 0 days.

(21) Appl. No.: 15/034,358

(22) PCT Filed: Nov. 3, 2014

(86) PCT No.: PCT/KR2014/010465
§ 371 (c)(1),
(2) Date: May 4, 2016

(87) PCT Pub. No.: WO2015/065139
PCT Pub. Date: May 7, 2015

(65) Prior Publication Data

US 2016/0272359 A1 Sep. 22, 2016

(30) Foreign Application Priority Data

Nov. 4, 2013 (KR) ..... 10-2013-0132657

(51) Int. Cl.
*B65D 5/08* (2006.01)
*B65D 5/24* (2006.01)

(52) U.S. Cl.
CPC ..... *B65D 5/08* (2013.01); *B65D 5/241* (2013.01)

(58) Field of Classification Search
CPC ..... B65D 5/08
USPC ..... 229/186
See application file for complete search history.

(56) References Cited

U.S. PATENT DOCUMENTS 598,344 A * 2/1898 Ingrey ..... B65D 5/6667 229/145
1,090,558 A * 3/1914 Morrison et al. .... B65D 5/3642 229/117.08
1,425,713 A * 8/1922 Stokes ..... B65D 5/248 229/144
2,021,980 A * 11/1935 Bachmeyer ..... B65D 5/3657 229/117.03
2,514,073 A * 7/1950 Karlson ..... B65D 5/36 229/117.01

(Continued)

FOREIGN PATENT DOCUMENTS

CN 2246012 Y 1/1997
JP 54-010447 U 1/1979
KR 20-0446794 Y1 12/2009

OTHER PUBLICATIONS

International Search Report for PCT/KR2014/010465 mailed Feb. 6, 2015 from Korean Intellectual Property Office.

*Primary Examiner* — Gary Elkins
(74) *Attorney, Agent, or Firm* — Paratus Law Group, PLLC

(57) ABSTRACT

Disclosed is an origami sheet for making a regular hexahedron box, including: first to fourth main outer wall sections connected successively along a longitudinal central area to be foldable with regard to one another; and first to fourth wing sections connected to both longitudinal sides of the first to fourth main outer wall sections to be foldable, respectively. The first and second wing sections and the third and fourth wing sections are connected to be foldable with regard to each other, and the second and third wing sections abut each other with interposed incision lines.

8 Claims, 4 Drawing Sheets

(56) References Cited

U.S. PATENT DOCUMENTS 4,791,883 A * 12/1988 Lehman ..... A01K 1/0125
119/168
4,809,907 A * 3/1989 Langer ..... B65D 5/241
229/145
4,890,576 A * 1/1990 James ..... B65D 5/0005
119/168
5,249,550 A * 10/1993 Hines ..... A01K 1/0125
119/165
5,538,288 A * 7/1996 Heath ..... B42D 5/04
283/2

* cited by examiner

ORIGAMI SHEET FOR MAKING REGULAR HEXAHEDRON BOX, ORIGAMI MONEY BOX, AND ORIGAMI PACKAGING BOX

CROSS REFERENCE TO PRIOR APPLICATIONS

This application is a National Stage Patent Application of PCT International Patent Application No. PCT/KR2014/010465 (filed on Nov. 3, 2014) under 35 U.S.C. §371, which claims priority to Korean Patent Application No. 10-2013-0132657 (filed on Nov. 4, 2013), which are all hereby incorporated by reference in their entirety.

TECHNICAL FIELD

The present invention relates to an origami sheet for making a regular hexahedron box, an origami money box, and an origami packaging box.

BACKGROUND ART

A number of ideas have been proposed such that, by folding leaflets or educational pamphlets and making regular hexahedron boxes, such as money boxes or packaging boxes, children can enjoy contact with educational information and recycle the sheet.

However, such conventional origami for making regular hexahedron boxes usually requires a separate tool or an adhesive. There is also a problem in that regular hexahedron boxes, which have been made, are not firm enough to maintain themselves for a comparatively long period of time. Such difficulty in the assembly process and the structural vulnerability make it hard to efficiently load enough contents in the sheet condition, seriously degrading the information conveying function, and failure to maintain the shape as a durable structure, after assembly, makes it difficult to fully exhibit the desired PR function.

DETAILED DESCRIPTION OF THE INVENTION

Technical Problem

Therefore, an aspect of the present invention is to provide an origami sheet for making a regular hexahedron box, an origami money box, and an origami packaging box, which can be easily fabricated without any separate adhesive or tool, and which has a maximized information conveying function.

Another aspect of the present invention is to provide an origami sheet for making a regular hexahedron box, an origami money box, and an origami packaging box, which can make the regular hexahedron box firm and maintain the shape, thereby performing a durable PR function.

Technical Solution

In accordance with an aspect of the present invention, there is provided an origami sheet for making a regular hexahedron box, including: first to fourth main outer wall sections connected successively along a longitudinal central area to be foldable with regard to one another; and first to fourth wing sections connected to both longitudinal sides of the first to fourth main outer wall sections to be foldable, respectively, wherein the first and second wing sections and the third and fourth wing sections are connected to be foldable with regard to each other, and the second and third wing sections abut each other with interposed incision lines.

Preferably, the first to fourth main outer wall sections successively form a bottom surface, a rear surface, an upper surface, and a front surface of a regular hexahedron box in an assembled state; the first and third wing sections overlap each other, in an assembled state, and form a side surface of the regular hexahedron box; and the second and fourth wing sections are folded diagonally, in an assembled state, and form a reinforcement wall that overlaps with one of the rear surface, the front surface, and the side surface.

In addition, the origami sheet preferably further includes a reinforcement extension that extends along a longitudinal direction from the longitudinal edges of the first wing sections and the first main outer wall section, because firmness in the assembled state can be enhanced; and the reinforcement extension more preferably has an extension length corresponding to an integer multiple of the length of the first main outer wall section, because the assembly process is facilitated.

In addition, the incision lines are preferably cutouts having predetermined widths, because no separate cutting-out process is required.

In accordance with another aspect of the present invention, there are provided an origami money box and an origami packaging box, which are made by folding the above-described origami sheet for making a regular hexahedron box.

Advantageous Effects

According to the present invention described above, the origami sheet for making a regular hexahedron box, the origami money box, and the origami packaging box enable the user to easily fabricate a regular hexahedron box in an insertion type, without using any separate adhesive or tool, such that enough contents can be loaded in the sheet, and the assembled regular hexahedron box can maintain the assembled state firmly for a long period of time.

MODE FOR CARRYING OUT THE INVENTION

Hereinafter, embodiments of the present invention will be described with reference to the accompanying drawings.

Figure 1:
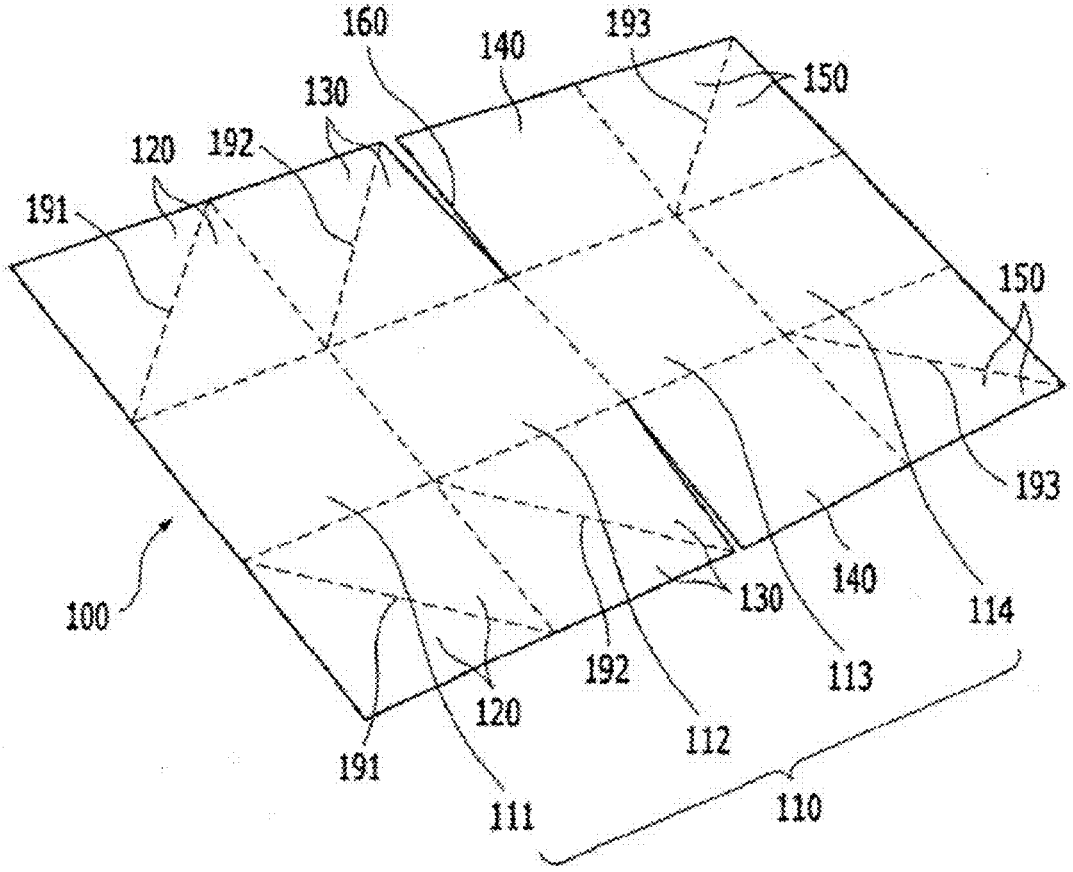
FIG. 1 is a perspective view illustrating an origami sheet for making a regular hexahedron box according to a first embodiment.

FIG. 1 is a perspective view of a first embodiment, which illustrates an origami sheet 100 for making a regular hexahedron box according to the present invention. The origami sheet 100 has approximately the shape of a rectangle, in which square sections are arranged in a 3×4 matrix type. The sheet 100 includes a main outer wall portion 110, which has four sections continuously arranged along a longitudinal central line, and first to fourth wing sections 120, 130, 140, and 150, which affiliate with respective sections of the main outer wall portion 110.

The main outer wall portion 110 is delimited successively into first to fourth main outer wall sections 111, 112, 113, and 114, and have folding lines interposed therebetween such that adjacent sections can be folded with regard to each other. First to fourth wing sections 120, 130, 140, and 150 are arranged on both sides of respective main outer wall sections 111, 112, 113, and 114. Respective wing sections 120, 130, 140, and 150 are connected, with interposed folding lines, so as to be foldable with regard to the corresponding main outer wall sections 111, 112, 113, and 114.

Folding lines are provided between the first wing sections 120 and the second wing sections 130, which then can be folded with regard to each other; likewise, folding lines are provided between the third wing sections 140 and the fourth wing sections 150, which then can be folded with regard to each other. However, the second wing sections 130 and the third wing sections 140 abut each other with incision lines 160 interposed therebetween, and are separated along the incision lines 160. The incision lines 160 are preferably cutouts having predetermined widths, as illustrated, such that interference can be reduced during folding processes. However, the incision lines 160 may be simple incisions or may be provided as incision line marks such that the user can incise the same with scissors, a knife, etc.; in some cases, the incision lines 160 may be bored sewing markings, which can be easily incised as needed.

Figure 4A:
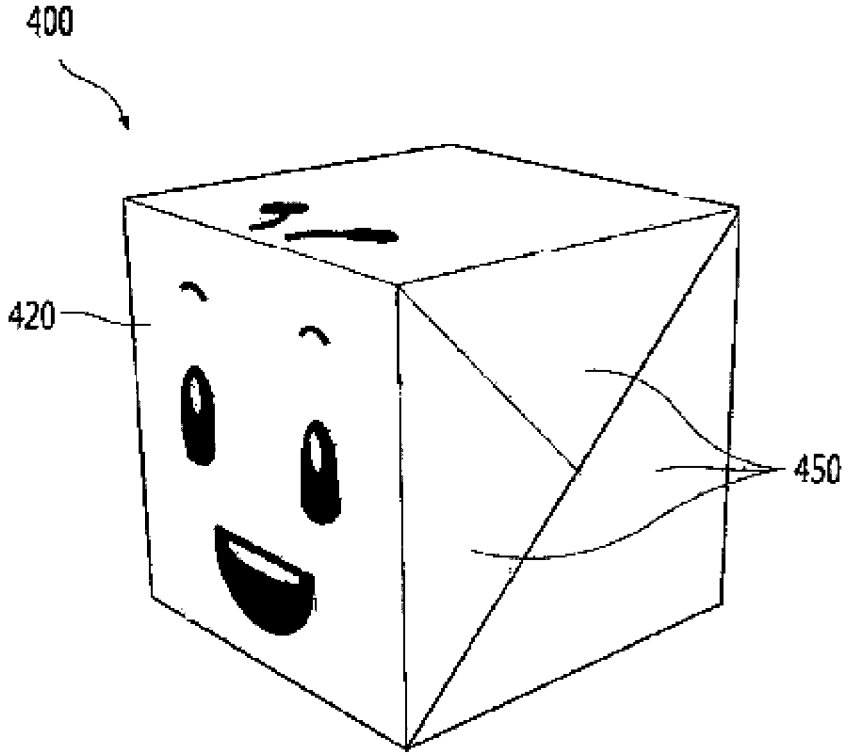
FIG. 4A and FIG. 4B are perspective views of a regular hexahedron box fabricated using an origami sheet.
Figure 4B:
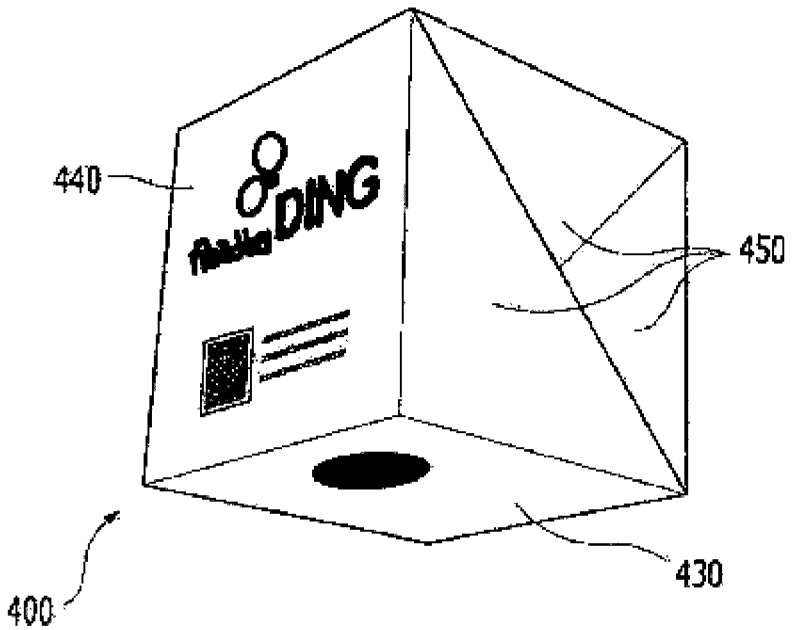

Referring to FIG. 4A and FIG. 4B, which illustrate an assembled regular hexahedron box, the first to fourth main outer wall sections 111, 112, 113, and 114 of the main outer wall portion 110 form the bottom surface 430, the rear surface 440, the upper surface 410, and the front surface 420 of the regular hexahedron box 400 in the assembled state, respectively.

The first wing sections 120 and the third wing sections 140 overlap each other in the assembled state and form the side surface 450 of the regular hexahedron box 400. The first wing sections 120, in the assembled state, are overlapped and folded on themselves along inner folding lines 191 that extend diagonally from vertices, at which the longitudinal end of the sheet 100 meets the folding lines with the first outer wall sections 111.

The second wing sections 130 are overlapped and folded on themselves along inner folding lines 192 that extend diagonally from vertices, which meet the first outer wall section 111, and overlap with the first wing sections 120 or the second main outer wall section 112, thereby forming a reinforcement wall. The fourth wing sections 150 are overlapped and folded on themselves along inner bending lines 193 that extend diagonally from vertices, which meet the third main outer wall section 113, and overlap with the third sing section 140 or the fourth main outer wall section 114, thereby forming a reinforcement wall.

Figure 2:
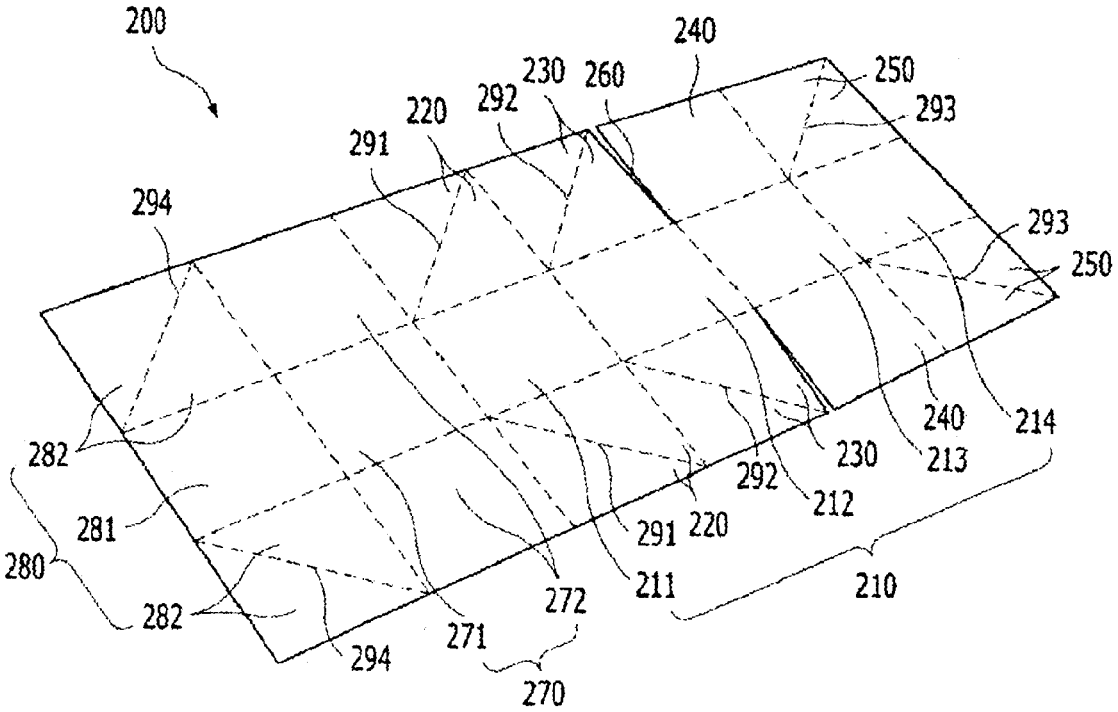
FIG. 2 is a perspective view illustrating an origami sheet according to a second embodiment.

FIG. 2 is a perspective view illustrating an origami sheet 200 for making a regular hexahedron box according to a second embodiment of the present invention. This embodiment has the same main outer wall portion 210 and the first to fourth wing sections 220, 230, 240, and 250, which are affiliated thereto, as those of the first embodiment, but additionally includes reinforcement extensions 270 and 280, which additionally extend from the first main outer wall section 210 and the first wing sections 220, respectively, along the longitudinal direction.

The first reinforcement extension 270 includes a first front reinforcement section 271, which is connected to the first outer wall section 211 in the longitudinal direction, and which can be folded with regard thereto, and first wing reinforcement sections 272, which are connected to both transverse sides of the front reinforcement section 271 to be foldable. The first front reinforcement section 271 and the first wing reinforcement section 272 play the role of reinforcing the front surface 420 and the side surface 450 of the regular hexahedron box 400, respectively.

The second reinforcement extension 280 is an additional longitudinal extension that can be folded with regard to the first reinforcement extension 270, and includes a second front reinforcement section 281, which abuts the first front reinforcement section 271, and second wing reinforcement sections 282, which are connected to both transverse sides of the second front reinforcement section 271 to be foldable. The second front reinforcement section 281 overlaps with the first front reinforcement section 271, and the second wing reinforcement sections 282 overlap with the first wing reinforcement sections 272, thereby reinforcing the front surface 420 and the side surface 450 of the regular hexahedron box 400. In this case, the second wing reinforcement sections 282 overlap with the wing reinforcement sections 272 while being folded so as to overlap themselves or unfolded.

The reinforcement extensions 270 and 280 are for the purpose of reinforcing the assembled regular hexahedron box, and can be employed optionally; therefore, it is possible to apply only one reinforcement extension 270 or to add a third reinforcement extension, if necessary. Furthermore, the length of extension of the reinforcement extension 270 may be smaller than the length of one side of the unit section.

FIG. 3A to FIG. 3K are perspective views illustrating processes of making a regular hexahedron box using the origami sheet for making a regular hexahedron box according to the second embodiment of the present invention. The folding processes according to the second embodiment are identical to the folding processes according to the first embodiment, except that processes for folding the reinforcement extensions 270 and 280 are added; therefore, separate description of the folding processes according to the first embodiment will be omitted herein.

Figure 3A:
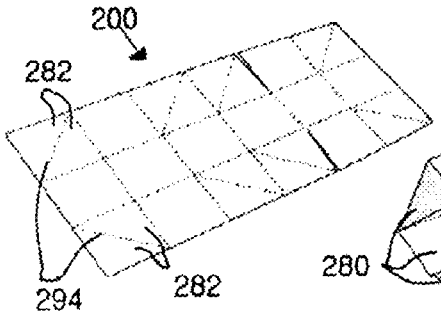
FIG. 3A to FIG. 3K are perspective views illustrating successive processes of assembling an origami regular hexahedron box according to the second embodiment.
Figure 3B:
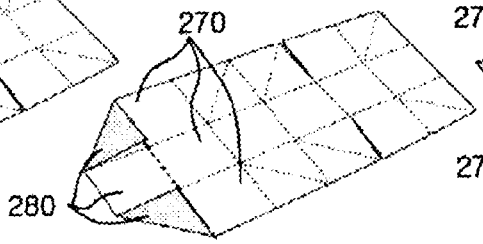
Figure 3C:
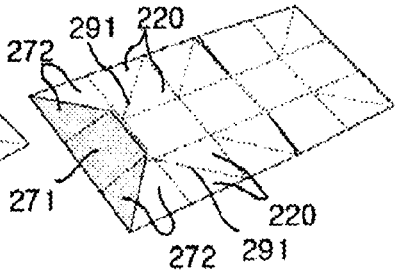
Figure 3D:
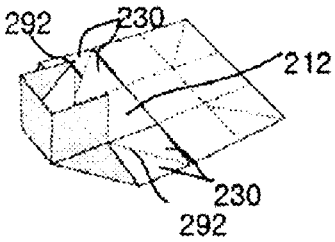
Figure 3E:
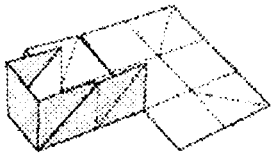
Figure 3F:
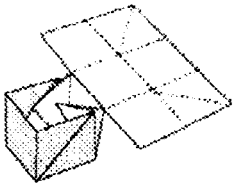
Figure 3G:
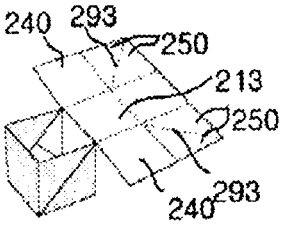
Figure 3H:
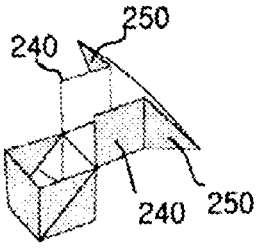
Figure 3I:
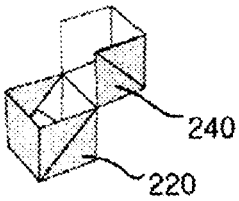
Figure 3J:
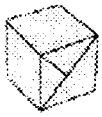
Figure 3K:
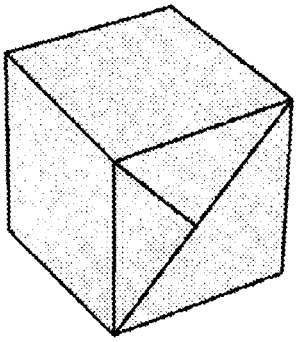

A rectangular origami sheet 200 for making a regular hexahedron box is first prepared; the second wing reinforcement sections 282 are folded inwards along the diagonal lines 294, as illustrated in FIG. 3A; and the second reinforcement extension 280 is then overlapped with the first reinforcement extension 270 (FIG. 3B and FIG. 3C). The second wing reinforcement sections 282 and the first wing reinforcement sections 272 are then overlapped and are folded in a direction perpendicular to the second front reinforcement section 281 and the first front reinforcement section 272, which have been overlapped with each other; and the first wing sections 220 are folded along the diagonal lines 291 towards the inner surface of the origami sheet 200, thereby forming a shape as illustrated in FIG. 3D. The second wing sections 230 are then folded to be perpendicular to the second main outer wall section 212, as illustrated in FIG. 3D and FIG. 3F, and the second outer wall section 212 is folded to be perpendicular to the first main outer wall section 211. In this case, the diagonal lines 292 of the second wing sections 230 are folded towards the inner surface of the origami sheet 200 so as to overlap with the second outer wall section 212 (FIG. 3F). The third wing sections 240 are then folded to be perpendicular to the third outer wall section 213, as illustrated in FIG. 3G and FIG. 3H, and the fourth sing sections 250 are folded along the diagonal lines 293 towards the inner surface of the origami sheet 200. The fourth wing sections 250, which have been folded along the diagonal lines 293, are then folded to overlap with the third wing sections 240, as illustrated in FIG. 3H and FIG. 3I. The third wing sections 240, which have been overlapped with the fourth wing sections 250, are inserted towards the first wing sections 220, which have been overlapped with the first wing reinforcement sections 272, as illustrated in FIG. 3I and FIG. 3J. FIG. 3K illustrates a regular hexahedron box 400 made by the above method.

FIG. 4A and FIG. 4B are perspective views illustrating a regular hexahedron box 400 made using origami sheets 100 and 200 according to the first to third embodiments of the present invention. Various kinds of advertisements, designs, messages, etc. may be printed on the outer surface of the regular hexahedron box 400, and various kinds of contents, which can stimulate the curiosity of children or help improve their learning ability, may be printed on the inner surface of the regular hexahedron box 400. Above contents are continuously exposed even after the regular hexahedron box 400 has been assembled, and become gifts that maximize the PR effect. In addition, the above-described origami sheets 100 and 200 have phrases, which describe the content or deliver information, printed on the inner surface thereof, have product-advertising designs or PR phrases printed on the outer surface thereof, and become packaging containers capable of containing articles. As a result, consumers can be well informed of descriptions of articles or guidelines, when opening the articles, and can reuse the same as money boxes or packaging containers of other articles; as such, the article packaging containers not only induce the consumer's interest, but also can be recycled.

BRIEF DESCRIPTION OF REFERENCE NUMERALS

100: origami sheet
110: main outer wall portion
120: first wing sections
130: second wing sections
140: third wing sections
150: fourth wing sections
160: incision lines
200: origami sheet
210: main outer wall portion
220: first wing sections
230: second wing sections
240: third wing sections
250: fourth wing sections
260: incision lines
270: first reinforcement extension
280: second reinforcement extension
400: regular hexahedron box
410: regular hexahedron box upper surface
420: regular hexahedron box front surface
430: regular hexahedron box bottom surface
440: regular hexahedron box rear surface
450: regular hexahedron box side surface

The invention claimed is:

1. An origami sheet for making a regular hexahedron box, comprising:

first to fourth main outer wall sections connected successively along a longitudinal central area to be foldable with regard to one another;

first to fourth wing sections connected to each longitudinal side of the first to fourth main outer wall sections to be foldable, respectively, wherein the first and second wing sections and the third and fourth wing sections are connected to be foldable with regard to each other, and the second and third wing sections are separated from each other by interposed incision lines; and a reinforcement extension that extends along a longitudinal direction from the longitudinal edges of the first wing sections and the first main outer wall section, wherein the reinforcement extension comprises a first reinforcement extension comprising a first front reinforcement section, which is connected to be foldable in the longitudinal direction from the first main outer wall section, and first wing reinforcement extensions connected to both transverse sides of the first front reinforcement section to be foldable, respectively, wherein the reinforcement extension comprises a second reinforcement extension comprising a second front reinforcement section, which is connected to be foldable in the longitudinal direction with regard to the first reinforcement extension and second wing reinforcement extensions connected to both transverse sides of the second front reinforcement section to be foldable, respectively, and the second wing reinforcement sections comprise inner folding lines that are formed diagonally from vertices, at which a longitudinal end of the sheet meets folding lines of the second front reinforcement section.

2. The origami sheet for making a regular hexahedron box of claim 1, wherein the first to fourth main outer wall sections successively form a bottom surface, a rear surface, an upper surface, and a front surface of a regular hexahedron box in an assembled state, the first and third wing sections overlap each other, in an assembled state, and form a side surface of the regular hexahedron box, and the second and fourth wing sections are folded diagonally, in an assembled state, and form a reinforcement wall that overlaps with one of the rear surface, the front surface, and the side surface.

3. The origami sheet for making a regular hexahedron box of claim 1, wherein the first wing sections comprise inner folding lines that are formed diagonally from vertices, at which a longitudinal end of the sheet meets folding lines with the first main outer wall section, the second wing sections comprise inner folding lines that are formed diagonally from vertices that meet with the first main outer wall section, and the fourth wing sections comprise inner folding lines that are formed diagonally from vertices that meet with the third main outer wall section.

4. The origami sheet for making a regular hexahedron box of claim 1, wherein the second front reinforcement section overlaps with the first front reinforcement section, and the second wing reinforcement sections overlap with the first wing reinforcement sections, thereby reinforcing the front and side surfaces of the regular hexahedron box.

5. The origami sheet for making a regular hexahedron box of claim 1, wherein the reinforcement extension has an extension length corresponding to an integer multiple of the length of the first main outer wall section.

6. The origami sheet for making a regular hexahedron box of claim 1, wherein the incision lines are cutouts having predetermined widths.

7. An origami-type money box characterized by being assembled by folding the sheet for making a regular hexahedron box according to claim 1.

8. An origami-type packaging box characterized by being assembled by folding the sheet for making a regular hexahedron box according to claim 1.

* * * * *